US009988869B2

(12) United States Patent
Kartha et al.

(10) Patent No.: US 9,988,869 B2
(45) Date of Patent: Jun. 5, 2018

(54) JARRING USING CONTROLLABLE POWERED BIDIRECTIONAL MECHANICAL JAR

(71) Applicant: Halliburton Energy Services, Inc., Houston, TX (US)

(72) Inventors: Nikhil Manmadhan Kartha, Singapore (SG); Mark S. Holly, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days. days.

(21) Appl. No.: 14/898,552

(22) PCT Filed: Sep. 11, 2014

(86) PCT No.: PCT/US2014/055222

§ 371 (c)(1),
(2) Date: Dec. 15, 2015

(87) PCT Pub. No.: WO2016/039760

PCT Pub. Date: Mar. 17, 2016

(65) Prior Publication Data

US 2017/0175475 A1 Jun. 22, 2017

(51) Int. Cl.
*E21B 31/107* (2006.01)
*E21B 33/068* (2006.01)

(52) U.S. Cl.
CPC ..... *E21B 31/107* (2013.01); *E21B 33/068* (2013.01)

(58) Field of Classification Search
CPC . E21B 1/00; E21B 4/06; E21B 31/107; E21B 31/113
See application file for complete search history.

(56) References Cited

U.S. PATENT DOCUMENTS 2,008,743 A * 7/1935 Black ..... E21B 31/107 175/304
2,872,158 A * 2/1959 Green ..... E21B 4/06 175/299
4,142,597 A * 3/1979 Johnston ..... E21B 31/107 166/178

(Continued)

OTHER PUBLICATIONS

International Search Report and Written Opinion, dated May 29, 2015, 11 pages; Korean Intellectual Property Office, International Searching Authority.

*Primary Examiner* — Taras P Bemko
*Assistant Examiner* — Ronald R Runyan

(57) ABSTRACT

A method for jarring allowing the operator to selectively control the jarring force while the tool is downhole and a powered bidirectional mechanical jar therefor, is disclosed. The jar includes a housing, an anvil fixed within the interior the housing, first and second hammers movably disposed within the housing at obverse sides of the anvil, first and second springs disposed to urge the hammers towards the anvil, and a rod with a radial catch that selectively engages and disengages the hammers so as move the hammers to compress the springs and thereafter release the hammers to be accelerated against the anvil. A actuator operates the catch. By controlling the movement of the rod, the spring compression and resultant jarring intensity can be controlled. A stroker tool may be provided to move the rod.

23 Claims, 9 Drawing Sheets

(56) References Cited

U.S. PATENT DOCUMENTS

| | | | | |
|---|---|---|---|---|
| 4,361,195 | A | 11/1982 | Evans | |
| 5,170,843 | A * | 12/1992 | Taylor | E21B 31/107 166/178 |
| 5,232,060 | A | 8/1993 | Evans | |
| 5,507,347 | A | 4/1996 | Estilette, Sr. | |
| 8,499,836 | B2 | 8/2013 | Moriarty et al. | |
| 2003/0075329 | A1 | 4/2003 | Day et al. | |
| 2006/0054322 | A1 | 3/2006 | Rose | |

* cited by examiner

JARRING USING CONTROLLABLE POWERED BIDIRECTIONAL MECHANICAL JAR

CROSS REFERENCE TO RELATED APPLICATIONS

The present application is a U.S. National Stage patent application of International Patent Application No. PCT/US2014/055222, filed on 11 Sep. 2014, the benefit of which is claimed and the disclosure of which is incorporated herein by reference in its entirety.

TECHNICAL FIELD

The present disclosure relates generally to oilfield equipment, and in particular to downhole tools, drilling and related systems and techniques for drilling, completing, servicing, and evaluating wellbores in the earth. More particularly still, the present disclosure relates to an improvement in systems and methods for jarring operations.

BACKGROUND

During the drilling, completion, servicing, or evaluation of an oil or gas wellbore or the like, situations are encountered wherein a downhole tool or a component of drill string or other conveyance becomes lodged in the wellbore. When the static force necessary to move a component exceeds the rig's capabilities or the tensile strength of the conveyance, the component is stuck and can no longer be moved or rotated. A jar is a tool that may be prepositioned within the string or other conveyance, such as wireline, e-line, slickline, etc., to free any component which may become stuck. Jars may also be used to shear pins, push or pull tools, actuate tools, et cetera.

A jar operates by releasing stored potential energy. Jarring is the process of converting potential energy into kinetic energy concentrated at a given point. In a typical jar, the potential energy available comes from over-pull (tensile) or set-down (compressive) forces applied to the drill pipe at the surface.

A typical jar may include a mandrel, which slides within a sleeve, and a detent mechanism. The mandrel functions as a hammer, and the sleeve functions as an anvil. The detent mechanism restricts the movement of the mandrel before releasing it ("firing"), so that sufficient potential energy is accumulated and transferred to the mandrel to cause, upon firing, the mandrel to rapidly move and strike the sleeve. This impact creates an impulse and the kinetic energy is transmitted as shock wave that travels up and down the tool string, drill string, or other conveyance to free a stuck tool or pipe, to shear pins, or to perform some other desired function.

A jar tool may be a double acting jar that can provide jarring force both upwards and downwards. The separate functions of jarring upward or downward may be accomplished in any sequence; that is, up only, down only, or alternately up and down. A jar may be classified as either of two types based on the detent mechanism: hydraulic and mechanical.

A hydraulic jar moves a piston with a fluid-filled hydraulic cylinder. Fluid passes from one side of the piston to the other through an orifice, triggering valve, or similar restriction which initially limits flow to create a time delay during the loading phase and then opens the flow path to trip the detent mechanism and fire the jar. In some hydraulic jars, the pressure piston must move a predetermined distance in order to bypass the restriction or open the triggering valve. The built-in delay is designed to allow the operator sufficient time to apply the desired tensile or compressive force to the drill string before the flow restriction is cleared or the triggering valve is opened. Therefore, varying the metering rate of the fluid through the restriction varies the magnitude of impact.

In contrast, a mechanical jar is actuated using a series of springs, locks, and rollers with release mechanisms. A mechanical jar fires upward at a preset tensile force and downward at a preset compressional force, which normally exceed the forces reached during drilling. Firing does not depend on the duration of the loading phase. A mechanical jar is typically either non-adjustable and made to deliver a preset amount of jarring force, or field-adjustable allowing setting at the surface before the jar is run into the wellbore.

BRIEF DESCRIPTION OF THE DRAWINGS

Embodiments are described in detail hereinafter with reference to the accompanying figures, in which.

DETAILED DESCRIPTION

Figure 1A:
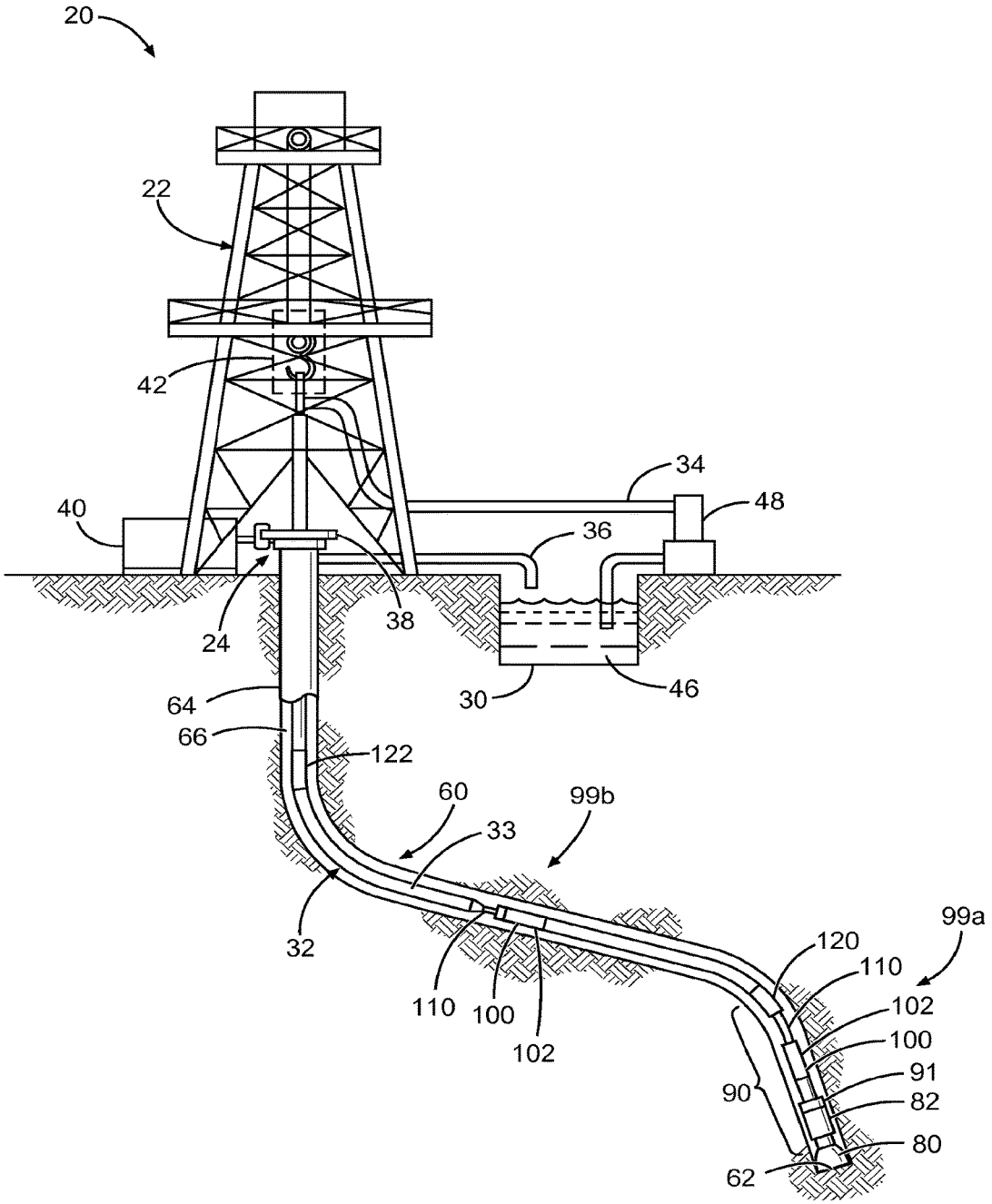
FIG. 1A is an elevation view in partial cross section of a drilling system that employs a drill string with drill pipe, and at least one controllable, powered bidirectional jarring tool assembly according to an embodiment.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1A is an elevation view in partial cross-section of a drilling system 20 including a bottom hole assembly 90 according to an embodiment. Drilling system 20 may include a drilling rig 22, such as the land drilling rig shown in FIG. 1A. However, teachings of the present disclosure may be used in association with drilling rigs 22 deployed on offshore platforms, semi-submersibles, drill ships, or any other drilling system for forming a wellbore.

Drilling rig 22 may be located proximate to or spaced apart from well head 24. Drilling rig 22 may include rotary table 38, rotary drive motor 40, and other equipment associated with rotation of drill string 32 within wellbore 60. Annulus 66 is formed between the exterior of drill string 32 and the inside wall of wellbore 60. For some applications drilling rig 22 may also include top drive motor or top drive unit 42. Blowout preventers (not expressly shown) and other equipment associated with drilling a wellbore may also be provided at well head 24.

The lower end of drill string 32 may include bottom hole assembly 90, which may carry at a distal end a rotary drill bit 80. Drilling fluid 46 may be pumped from reservoir 30 by one or more mud pumps 48, through conduit 34, to the upper end of drill string 32 extending out of well head 24. The drilling fluid 46 then flows through the longitudinal interior 33 of drill string 32, through bottom hole assembly 90, and exits from nozzles formed in rotary drill bit 80. At bottom end 62 of wellbore 60, drilling fluid 46 may mix with formation cuttings and other downhole fluids and debris. The drilling fluid mixture then flows upwardly through annulus 66 to return formation cuttings and other downhole debris to the surface. Conduit 36 may return the fluid to reservoir 30, but various types of screens, filters and/or centrifuges (not expressly shown) may be provided to remove formation cuttings and other downhole debris prior to returning drilling fluid to reservoir 30. Various types of pipes, tube and/or hoses may be used to form conduits 34 and 36.

Bottom hole assembly 90 may include a downhole mud motor 82, which may have a bent housing. Bottom hole assembly 90 may also include various other tools 91, such as those that provide logging or measurement data and other information from the bottom of wellbore 60. Measurement data and other information may be communicated from end 62 of wellbore 60 using measurement while drilling techniques using electrical signals or other communication media that can be converted to electrical signals at the well surface to, among other things, monitor the performance of drilling string 32, bottom hole assembly 90, and associated rotary drill bit 80.

Drill string 32 includes a jarring tool assembly 99 with jar 100. Jarring tool assembly 99 may be located in bottom hole assembly 90 or elsewhere along drill string 32. Although not illustrated, stroker tool 120 and/or drill string 32 may include an anchoring device, such as an inflatable packer. In some configurations, multiple jarring tool assemblies 99 may be included in drill string 32. Jar 100 includes a housing 102 and a stroke rod 110, which is linearly stroked with respect to jar housing 102 to transfer potential energy to jar 100 and to cock jar 100 for firing, as described in greater detail below.

FIG. 1A illustrates two jarring tool assemblies 99 according to various embodiments of the present disclosure. According to a first embodiment, interface stroke rod 110 of jarring tool assembly 99*a* is connected to a stroker tool 120, which functions downhole to stroke rod 110 as described below. According to a second embodiment, stroke rod 110 of jarring tool assembly 99*b* is connected directly to drill string 32, which may function to stroke rod 110 relative to housing 102.

Although the embodiments of FIG. 1A are described as a drilling system using a drill string, the present disclosure is not limited to a single embodiment. Accordingly, the term "drilling system" broadly includes various production systems, completion systems, workover systems, and the like used with wellbores. Likewise, the term "drill string," as used herein broadly encompasses any conveyance for downhole use, including working strings, completion strings, evaluation strings, other tubular members, wireline systems, and the like. For example, FIG. 1B shows a system view of a well servicing system 200 including a wireline cable deployment of the present disclosure according to an embodiment.

Figure 1B:
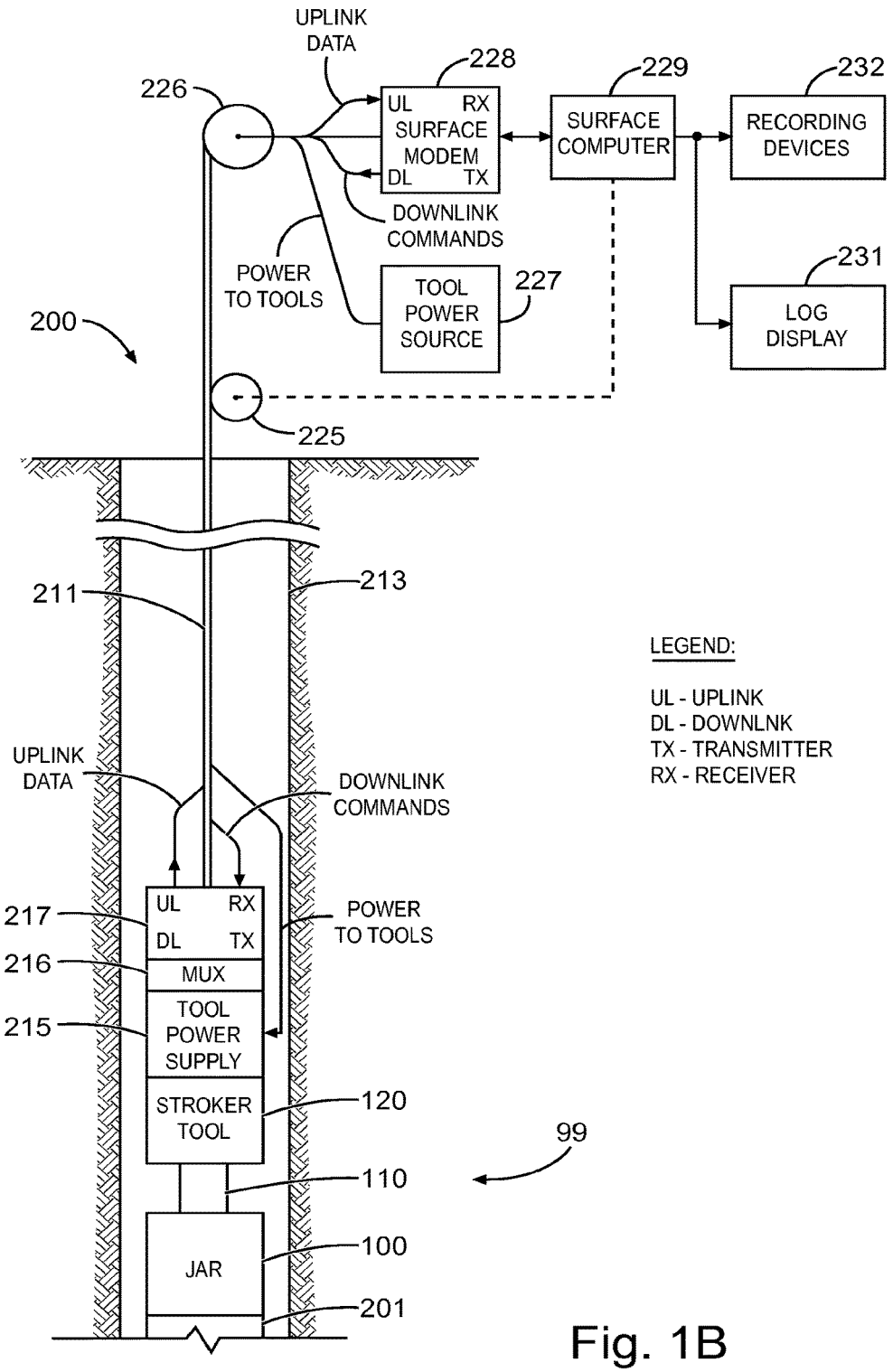
FIG. 1B is a block-level schematic diagram of a well servicing or like system according to an embodiment, showing downhole tools including powered bidirectional jarring tool assembly suspended by wireline in a well.

Referring to FIG. 1B, a wireline cable 211 suspends jarring tool assembly 99 in wellbore 213, including jar 100 optionally connected to stroker tool 120 at stroke rod 110. Wellbore 213 may have been drilled by a drill bit on a drill string as illustrated in FIG. 1A, and wellbore 213 may be uncased or lined with casing. Wellbore 213 can be any depth and the length of wireline cable 211 may be any length appropriate for the depth of wellbore 213.

Various other types of tools 201 may also be suspended by wireline cable 211 in wellbore 213. Jarring tool assembly 99 and other tools 201 may be supported by a downhole power supply 215, multiplexer 216, and/or communications module 217. Communications module 217 may include an uplink communication device, a downlink communication device, a data transmitter, and/or a data receiver.

Well servicing system 200 includes a sheave 225 which is used for guiding wireline cable 211 into wellbore 213. Wireline cable 211 is spooled on a cable reel 226 or drum for storage. Wireline cable 211 connects with the downhole equipment and is spooled out or taken in to raise and lower the tools in wellbore 213.

Wireline cable 211 may include electrical, optical, or hydraulic conductors that connect with surface-located equipment, which may include a DC power source 227 to provide power to downhole power supply 215, a surface communication module 228 having an uplink communication device, a downlink communication device, a data transmitter, a data receiver, a surface computer 229, a display 231, and/or one or more recording devices 232. Sheave 225 may be connected to surface computer 229 by a suitable communication means to provide depth measuring information. Surface computer 229 may provide output to display 31 and/or recording device 32.

Figure 2A:
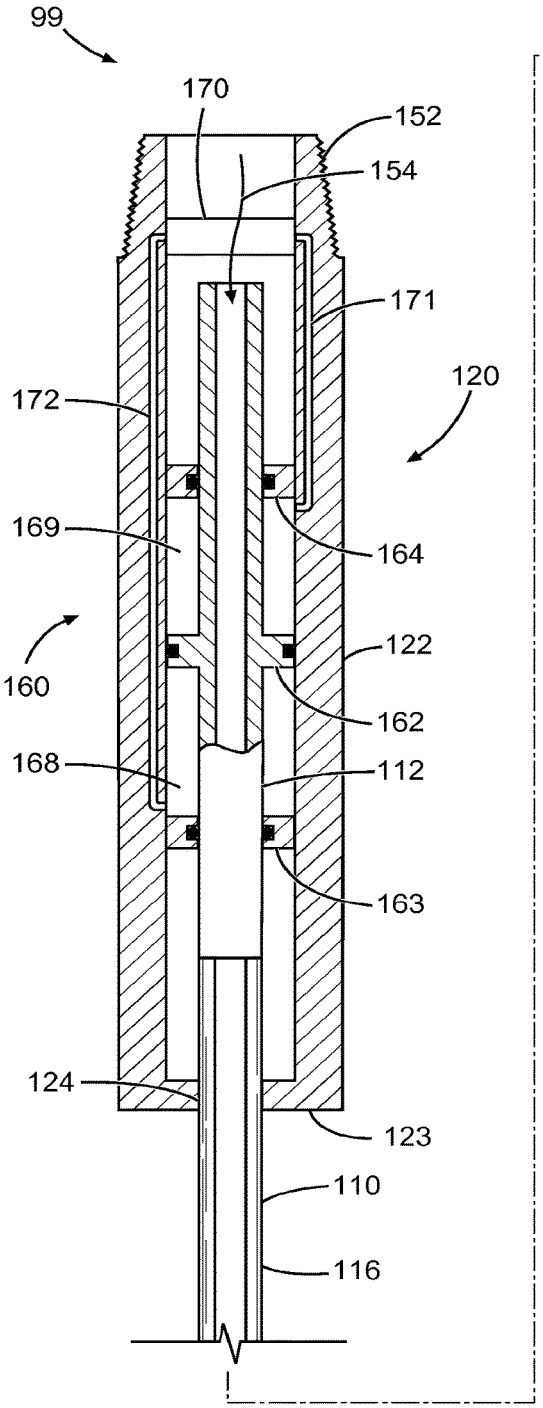
FIG. 2A is an elevation view of a stroker of FIG. 1A or 1B according to an embodiment, shown in partial cross section along a longitudinal axis thereof to reveal a pump and hydraulic ram for moving an interface rod.
Figure 2B:
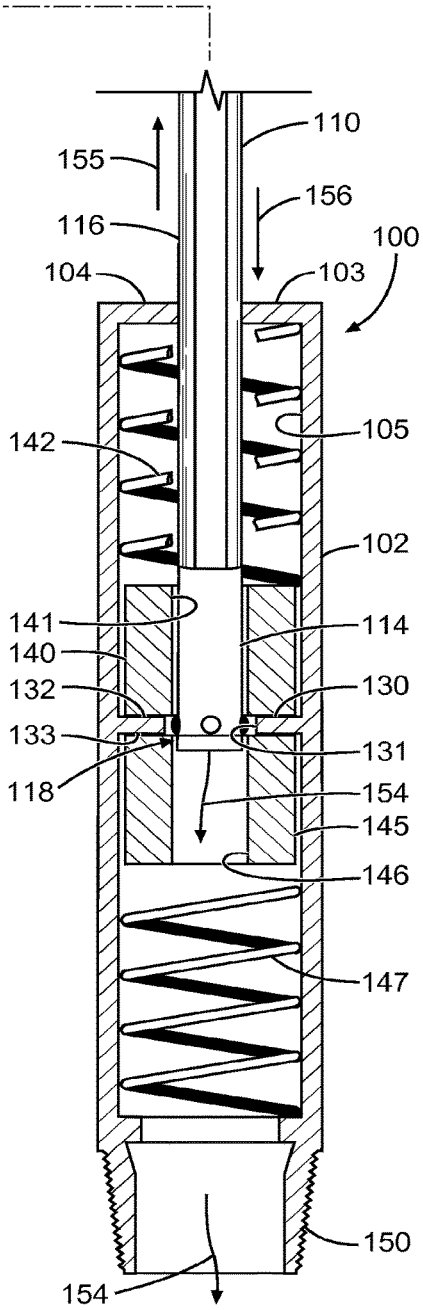
FIG. 2B is an elevation view of a jar of FIG. 1A or 1B according to an embodiment, shown in partial cross section along a longitudinal axis thereof to reveal a central anvil, first and second hammers urged toward the anvil by first and second springs, and an interface rod carrying a catch for engaging the hammers.

FIGS. 2A and 2B together show an elevation view of a jarring tool assembly 99, which includes jar 100 and may include a stroker tool 120, according to an embodiment. With the exception of interface stroke rod 110, jar 100 and stroker 120 are shown in axial cross section to illustrate the operation of jarring tool assembly 99.

Jarring tool assembly 99 as shown in FIGS. 2A and 2B is arranged for connection within drill string 32 (FIG. 1A). Accordingly, jar 100 and stroker tool 120 include connections 150, 152, which may be threaded pins or the like. Jarring tool assembly 99 may include a flow path, such as that illustrated by arrows 154, for drilling fluid or other well treatment to pass through the tool. Fluid from drill string 32 (FIG. 1A) may enter the housing 122 of stroker 120 at connection 152. Stroker 120 may include a hollow piston rod 112, which is fixed to a hollow stroke rod 110. Fluid may then enter the distal end of piston rod, flow through piston rod 112 into stroke rod 110, and exit the distal end of stroke rod 110. Fluid flow may continue through jar housing 102, exiting into drill string 32 (FIG. 1A) through connection 150.

Jarring tool assembly 99 may be arranged for transmitting drill string torque. According to an embodiment, stroke rod may have a portion with a circular outer wall 114 and a portion with a hexagonal outer wall 116. The medial end 123 of housing 122 of stroker 120 may include an aperture 124 having a hexagonal shape dimensioned so that hexagonal outer wall 116 can slide therein and torque applied to housing 122 is transferred to stroke rod 110. Similarly, the medial end 103 of housing 102 of jar 100 may include an aperture 104 having a hexagonal shape dimensioned so that hexagonal outer wall 116 can slide therein and torque applied to stroke rod 110 is transferred to housing 102. Circular outer wall 114 is dimensioned so that it will not pass through hexagonal aperture 104, thereby preventing stroke rod 110 from being removed from jar 100. Although a hexagonal shape is described herein, other spline profiles that allow sliding movement and torque transmission may be used as appropriate.

Jar 100 includes a shaped anvil 130, which is located on the interior wall 105 of housing 102. Anvil 130 has a longitudinal bore 131 formed therethrough, and in an embodiment bore 131 is coaxial with housing 102. Anvil 130 is rigidly fixed to housing 102 so that jarring forces acting upon anvil 130 are transferred to drill string 32 (FIG. 1A). In an embodiment, anvil 130 may be integrally formed with housing 102. Jar 100 also includes a first hammer 140, which is axially movable within housing 102, and a first spring 142 which urges first hammer 140 in a first axial direction (indicated by arrow 156) against anvil 130. First hammer has a longitudinal bore 141 formed therethrough, and in an embodiment bore 141 is coaxial with housing 102.

Stroke rod 110 includes a catch 118, which may be located at or near the distal end of stroke rod 110. As described in greater detail below with respect to FIGS. 3A and 3B, in a disengaged position, catch 118 is not engaged with first hammer 140 and in an engaged position, catch 118 is engaged with hammer 140. In one or more embodiments, catch 118 may be radially extended into the engaged position and retracted into the disengaged position. Regardless of whether catch 118 is in the engaged or disengaged position, stroke rod 110 is dimensioned so as to pass freely through anvil bore 131. When catch 118 is in a disengaged position, stroke rod 110 is dimensioned so as to pass through first hammer bore 141. However, when catch 118 is extended in the engaged position, catch 118 will not pass through first hammer bore 141. In this manner, as described in greater tail below with respect to FIGS. 4A-4F, by selectively engaging catch 118, stroke rod 110 may be used to move first hammer 140 in a second axial direction (indicated by arrow 155) away from away from anvil 130 to compress first spring 142, storing potential energy and putting jar 100 in a cocked state; then by selectively disengaging catch 118, first hammer is released and accelerated by first spring 142 against anvil 130, creating a jarring effect in the first axial direction 156. The extent to which first hammer 142 is moved to compress first spring 142 determines the resultant jarring force.

In a preferred embodiment, as illustrated in FIG. 2B, jar 100 is capable of bidirectional jarring. In such an embodiment, anvil 130 may be located approximately midway along the axial length of housing 102 and may have first and second sides 132, 133 forming obverse striking surfaces for bidirectional jarring. In other embodiments, separate anvils 130 may be provided for each hammer. First hammer 140 is located to a first side of anvil 130 and is urged against striking surface 132 by first spring 142. A second hammer 145, which is axially movable within housing 102, and a second spring 147 which urges second hammer 145 in the second axial direction 155 against striking surface 133 of anvil 130, are provided. Second hammer 145 has a longitudinal bore 146 formed therethrough, and in an embodiment bore 146 is coaxial with housing 102. As with first hammer 140, when catch 118 is in a disengaged position, stroke rod 110 is dimensioned so as to pass through second hammer bore 146, and when catch 118 is extended in the engaged position, catch 118 will not pass through second hammer bore 146. Accordingly, as described in greater tail below with respect to FIGS. 5A-5F, stroke rod 110 may also be used to move second hammer 140 in the first axial direction 156 away from away from anvil 130 to compress second spring 147 and then release second hammer 145 for creating a jarring effect in the second axial direction 155.

According to an embodiment, as shown in FIG. 2A, jarring tool assembly 99 includes stroker tool 120, which is operable to move stroke rod 110 with respect to jar housing 102. Stroker tool 120 may include a hydraulic ram actuator 160 having a piston 162 connected to piston rod 112. Piston 162 is dynamically sealed and moves linearly in a hydraulic cylinder defined by inner wall 161 and first and second end caps 163, 164. Piston rod 112 is dynamically sealed within apertures formed through first and second end caps 163, 164.

Piston rod 112, piston 162, inner wall 161, and first end cap 163 define a first hydraulic chamber 168, and piston rod 112, piston 162, inner wall 161, and second end cap 164 define a second hydraulic chamber 169. First and second hydraulic chambers 168, 169 are fluidly coupled via hydraulic pump 170 and flow channels 171, 172. Pump 170 may be selectively actuated to transfer fluid from chamber 169 to 168, thereby moving piston 162, piston rod 112, and stroke rod 110 in the second axial direction 155 (referred to above with respect to jar 100). Conversely, pump 170 may be selectively actuated to transfer fluid from chamber 168 to 169, thereby moving piston 162, piston rod 112, and stroke rod 110 in the first axial direction 156 (referred to above with respect to jar 100).

Figure 3A:
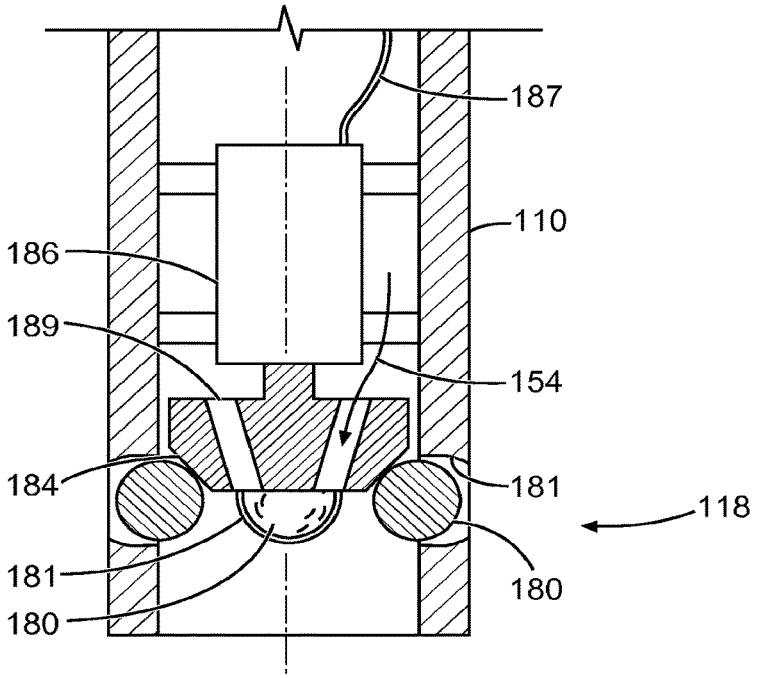
FIG. 3A is an enlarged axial cross section of the catch of FIG. 2B according to an embodiment, showing the catch in a disengaged position.
Figure 3B:
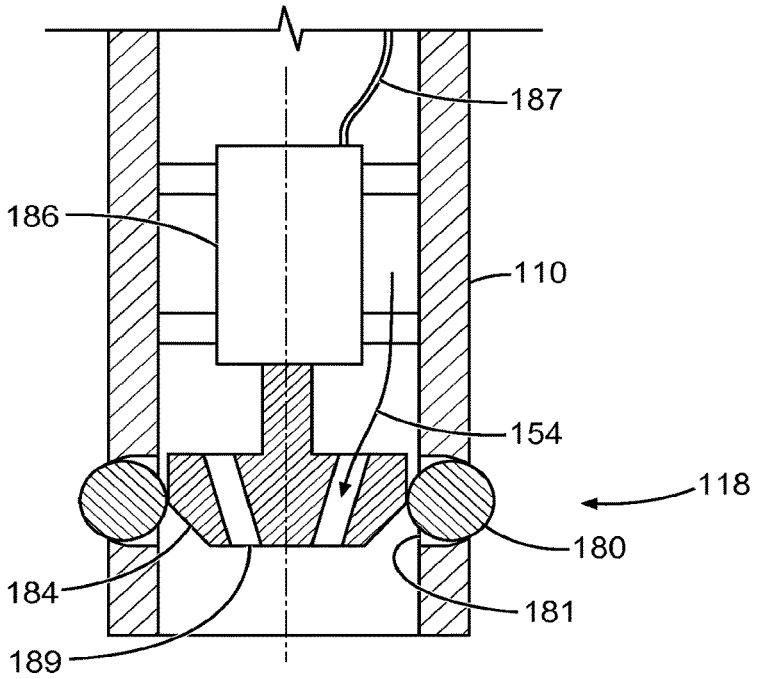
FIG. 3B is an enlarged axial cross section of the catch of FIG. 3A, showing the catch in an engaged position.

FIGS. 3A and 3B show enlarged axial partial cross sections of catch 18 of carried by stroke rod 110 according to an embodiment, showing the catch in disengaged and engaged positions, respectively. The disclosure is not limited to a particular configuration of catch 118 so long as catch 118 functions to engage and disengage hammers 140, 145. In one or more preferred embodiments, catch 118 may include one or more radially movable fingers 180 that are actuated to move radially inward and outward relative to the stroke rod 110. In one or more embodiments, such fingers are balls 180 movably captured within tapered radial apertures 181 formed in stroke rod 110. As shown most clearly in FIG. 3B, apertures 181 are dimensioned so that ball(s) 180 may extend partially beyond the outer circumference of stroke rod 110 but cannot completely pass through aperture 181. In the embodiment illustrated in FIGS. 3A and 3B, four balls 180 are provided at 90 degree spacing, however, a greater or lesser number of balls 180 may be provided as appropriate.

A cone 184, which may broadly include a frustoconical- or pyramid-shaped structure having tapered or curved surfaces for engaging balls 180 is provided, whereby the tapered surfaces form a first portion of the cone 184 with a surface of a larger diameter and a second portion of the cone 184 with a surface of a diameter smaller than the first diameter. Cone 184 may be moved axially by an actuator 186, which may be a solenoid, or hydraulic piston-cylinder arrangement, for example. Actuator 186 may include control/power lines 187, which may pass through stroke rod 110 to stroker 120 or another device via drill pipe 32 (FIG. 1A), for example. Cone 184 may include one or more flow passages 189 formed therethrough for accommodating drill string fluid flow.

While one embodiment of catch is described as having a cone 184 and balls 180, in other embodiments, for example, fingers 180 may be pins seated in a piston which pins can be moved radially outward under pressure from within the piston.

As shown in FIG. 3A, when catch 18 is in the inward, disengaged position, a second portion of cone 184 having a smaller diameter engages balls 180 thereby allowing balls 180 to be substantially contained within stroke rod. In this position, cone 184 still captures balls 180 partially within apertures 181. Should any ball 180 continue to extend radially outward from stroke rod 110 after catch 18 is disengaged, any external force acting thereon, such as from first or second hammer 140, 145 (FIG. 2B), will urge the ball inward. As shown in FIG. 3B, when catch 18 extends radially outward from said stroke rod 110, in the engaged position, a first portion of cone 184 having a larger diameter engages balls 180 forces balls 180 to extend radially outward from stroke rod 110.

While the figures illustrate catch 18 engaging a hammer 140, 141 at an end of the respective hammer, in other embodiments, catch 18 may engage the respective hammer anywhere along the length of the hammer. For example, a seat or cavity (not shown) may be provided at any point along the length of longitudinal bore 141 for receipt of catch 18.

Figure 4A:
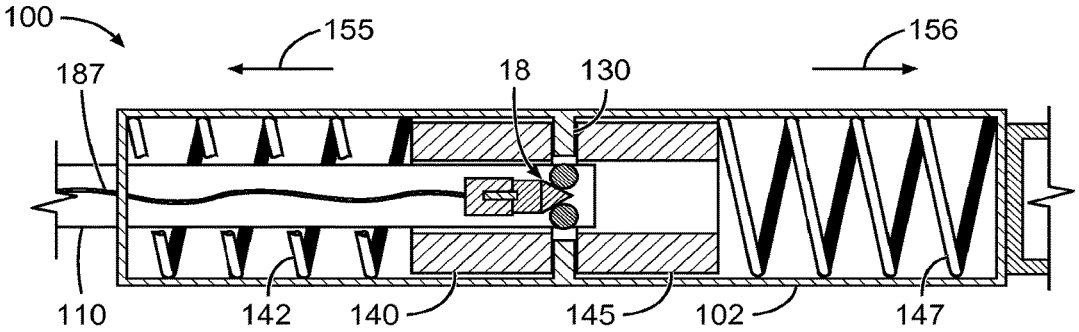
FIGS. 4A-4F are simplified axial cross sections of the jar of FIG. 2B that illustrate the operational sequence for creating a jarring force in a first axial direction.
Figure 4B:
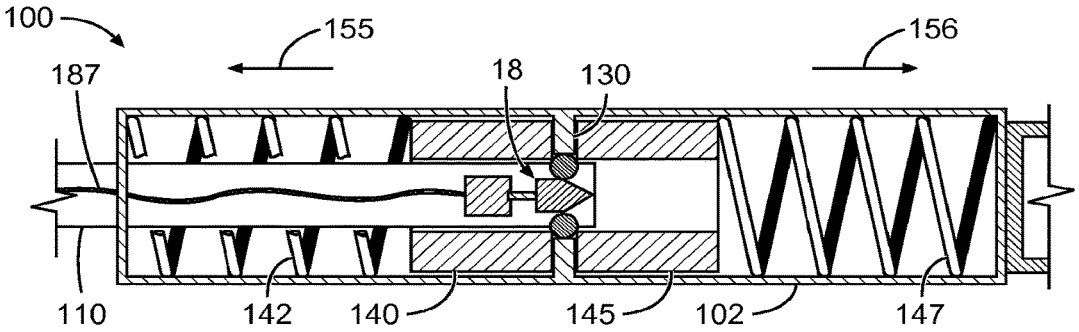
Figure 6:
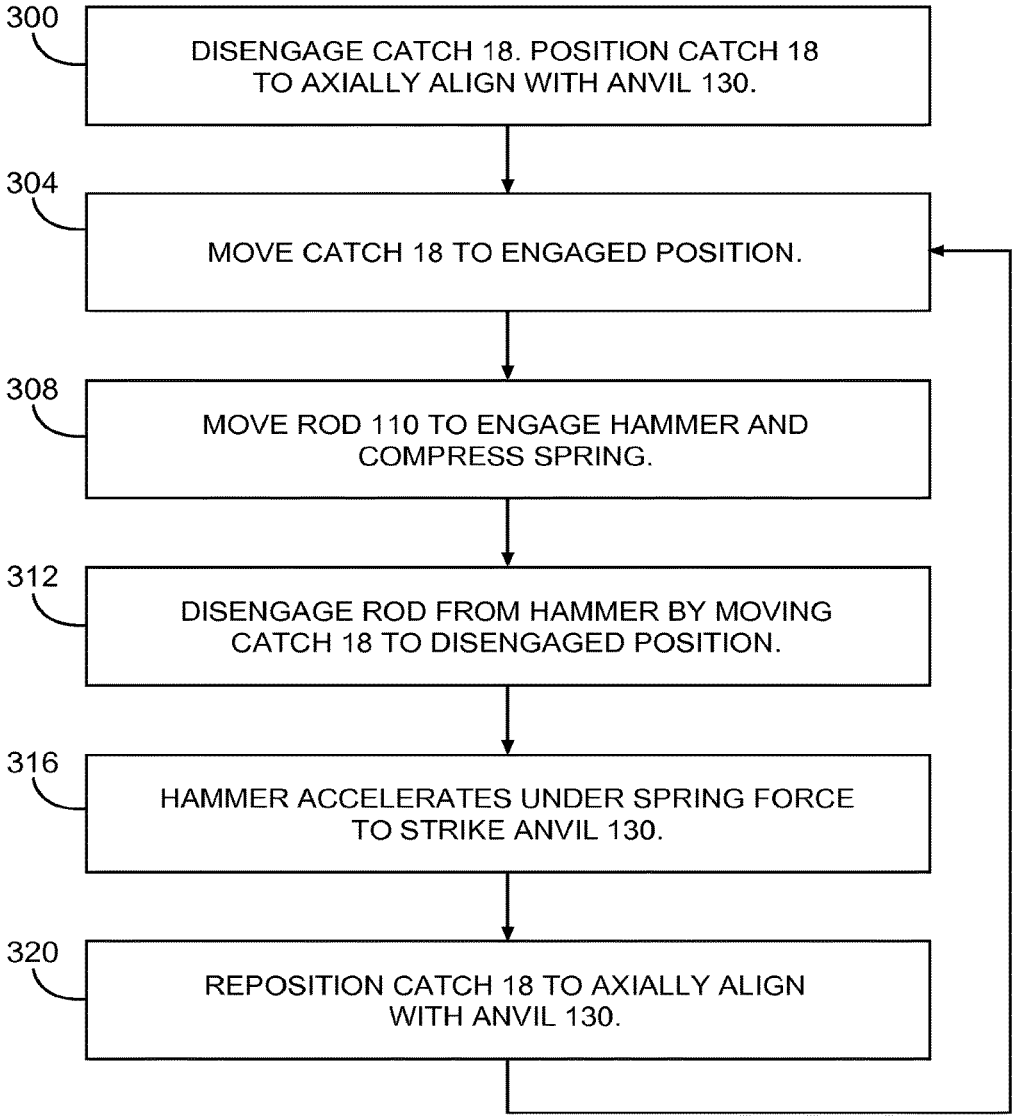
FIG. 6 is a flow chart showing a method for creating a jarring force along a drill string for use with jar tools such as those illustrated in FIGS. 4A-4F and 5A-5F.

FIGS. 4A-4F are simplified axial cross sections of jar 100 according to an embodiment that illustrate the process of creating a jarring force in first axial direction 156 using first hammer 140. FIG. 6 is a flowchart describing a method for creating a jarring force in a wellbore. Referring to FIGS. 4A-4F and 6, FIG. 4A shows stroke rod 110 of jar 100 in an initial condition according to step 300 where stroke rod 110 is positioned to align with anvil 130. Catch 18 is disengaged so that stroke rod 110 can move axially independently of hammers 140, 145. In step 304, first hammer 140 is engaged by stroke rod 110. More specifically, stroke rod 110 may be positioned adjacent first hammer 140 and catch 18 is actuated so as to extend radially outward to engage first hammer 140. FIG. 4B illustrates this state.

Figure 4C:
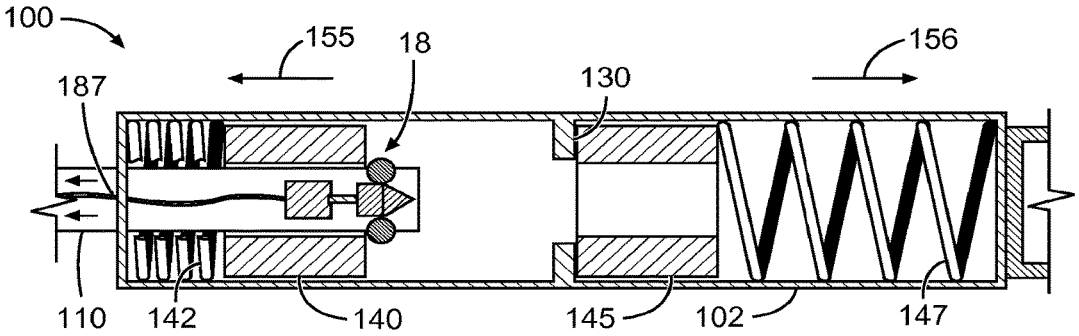
Figure 4D:
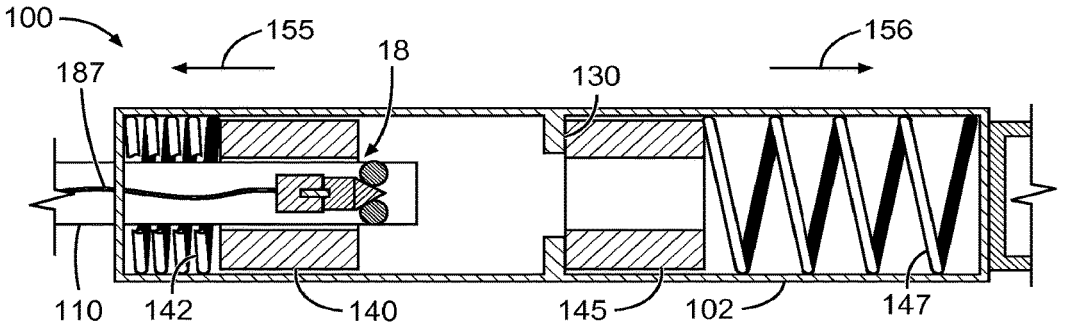
Figure 4E:
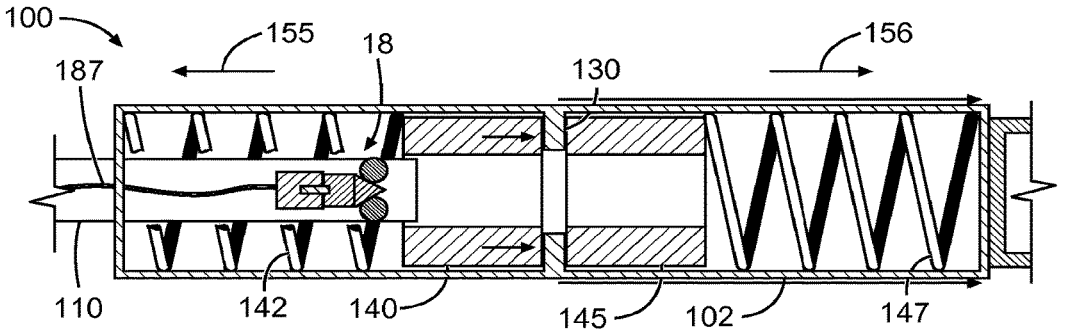
Figure 4F:
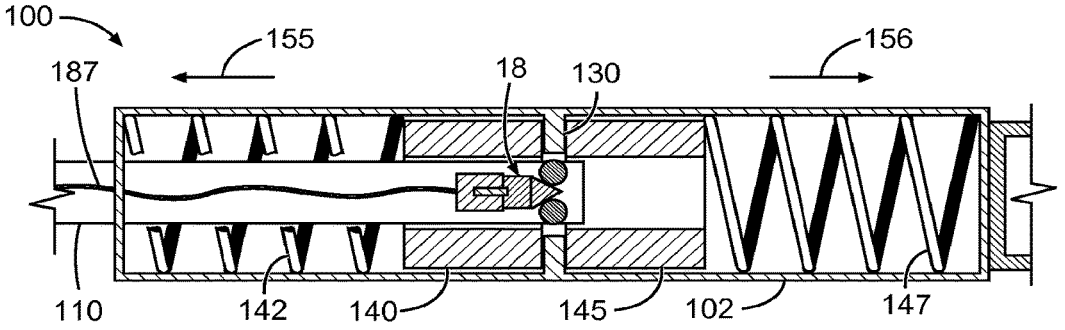

At step 308, stroke rod 110 is used to move first hammer 140 in a second axial direction 155 opposite the first axial direction 156, thereby causing the first hammer 140 to compress a first spring 142, as shown in FIG. 4C. To fire jar 100, at step 312, catch 18 is disengaged (FIG. 4D) from first hammer 140, so that at step 316, first hammer 140 is allowed to rapidly accelerate under the force of spring 142 to strike anvil 130, thereby creating a jarring force in first axial diction 156 (FIG. 4E). At step 320, stroke rod 110 is moved to place jar 100 in the initial condition again, with catch 18 axially aligned with anvil 130 (FIG. 4F), and the process may be repeated, starting with step 304, to provide jarring in first direction 156, as just described, or to provide jarring in second direction 155, as described below.

Figure 5A:
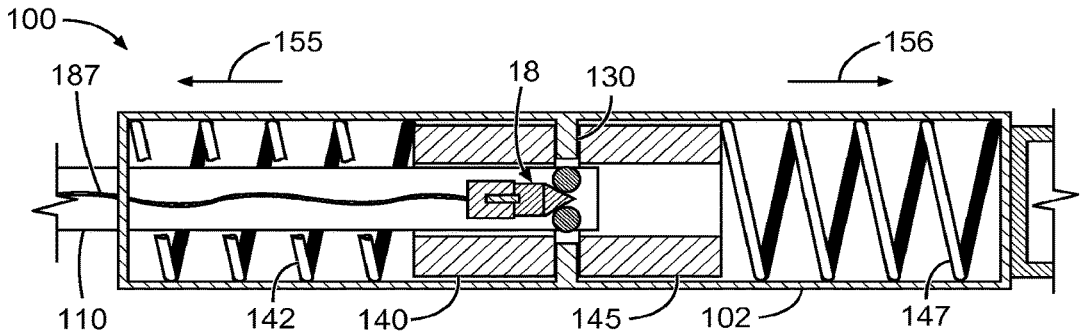
FIGS. 5A-5F are simplified axial cross sections of the jar of FIG. 2B that illustrate the operational sequence for creating a jarring force in a second axial direction.
Figure 5B:
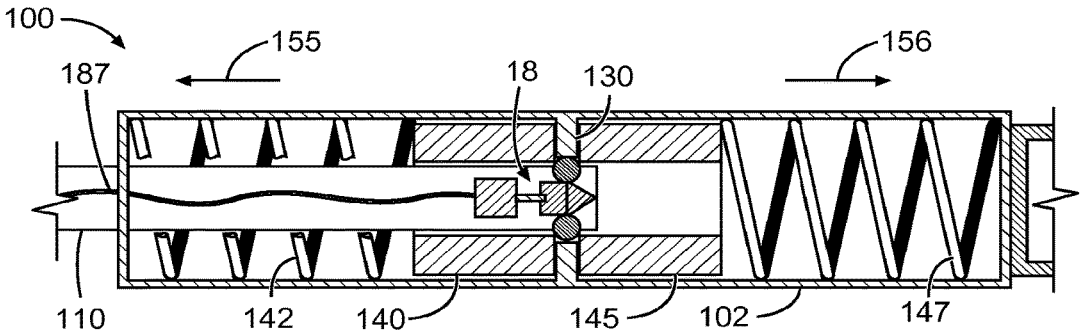

FIGS. 5A-5F are simplified axial cross sections of jar 100 according to an embodiment that illustrate the process of creating a jarring force in second axial direction 155 using second hammer 145. Referring to FIGS. 5A-5F and 6, FIG. 5A shows stroke rod 110 of jar 100 in an initial condition according to step 300 where stroke rod 110 is positioned to align with anvil 130. Catch 18 is disengaged so that stroke rod 110 can move axially independently of hammers 140, 145. In step 304, second hammer 145 is engaged by stroke rod 110. More specifically, stroke rod 110 may be positioned adjacent second hammer 145 and catch 18 is actuated so as to extend radially outward to engage second hammer 145. FIG. 5B illustrates this state.

Figure 5C:
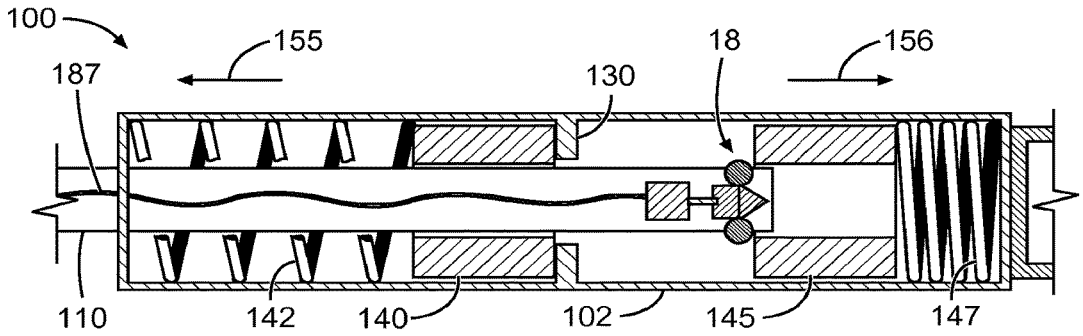
Figure 5D:
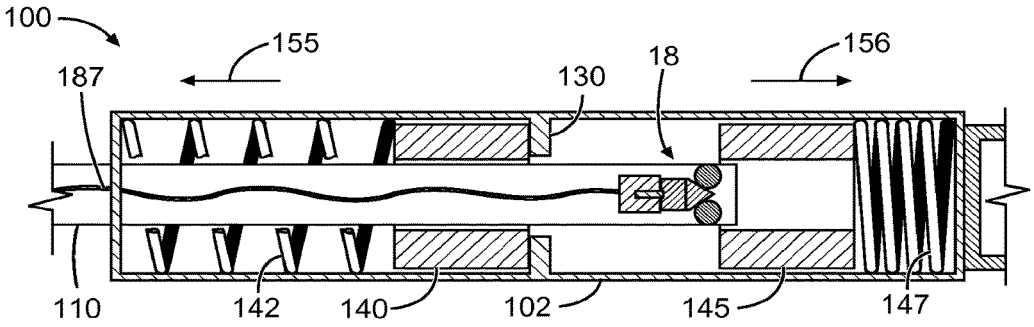
Figure 5E:
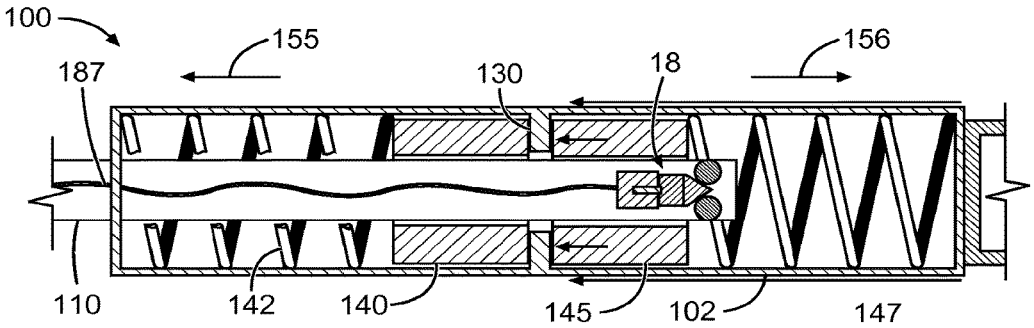
Figure 5F:
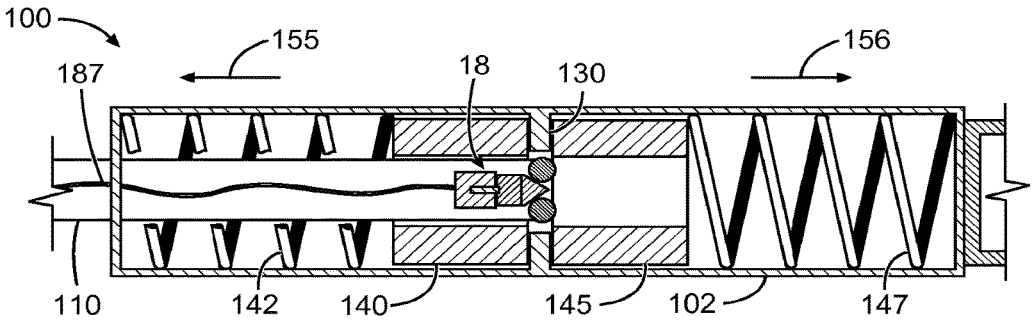

At step 308, stroke rod 110 is used to move second hammer 145 in first axial direction 156, thereby causing second hammer 145 to compress a second spring 147, as shown in FIG. 5C. To fire jar 100, at step 312, catch 18 is disengaged (FIG. 5D) from second hammer 145, so that at step 316, second hammer 145 is allowed to rapidly accelerate under the force of spring 147 to strike anvil 130, thereby creating a jarring force in the second axial diction 155 (FIG. 5E). At step 320, stroke rod 110 is moved to place jar 100 in the initial condition again, with catch 18 axially aligned with anvil 130 (FIG. 5F), and the process may be repeated, starting with step 304, to provide jarring in first direction 156 or second direction 155.

In summary, a jarring tool assembly, jarring system for use in a wellbore, and a method for creating a jarring force have been described. Embodiments of the jarring tool assembly may generally have: A generally cylindrical housing; an anvil fixed within the interior the housing; a first hammer movably disposed within the housing at a first side of the anvil; a first spring disposed within the housing so as to urge the first hammer towards the anvil in a first axial direction; a stroke rod at least partially disposed and axially movable within the housing, the stroke rod being selectively movable with respect to the first hammer; a catch carried by the stroke rod and being radially movable with respect to the stroke rod between a disengaged position and an engaged position; and an actuator coupled to the catch so as to selectively move the catch between the disengaged and engaged positions; wherein in the disengaged position, the stroke rod is freely movable with respect to the first hammer in the first axial direction and in a second axial direction opposite the first axial direction; and in the engaged position, the catch is positioned for engagement with the first hammer so that the stroke rod becomes fixed to the first hammer during movement in the second axial direction. Embodiments of the jarring system for use in a wellbore may generally have: A conveyance; and a jar carried by the conveyance and disposed within the wellbore, the jar including an anvil fixed within the interior of a housing, a first hammer movably disposed within the housing and positioned on a first side of the anvil, a first spring disposed within the housing to urge the first hammer towards the anvil in a first axial direction, a stroke rod at least partially and movably disposed within the housing, the stroke rod being selectively movable with respect to the first hammer, a catch carried by the stroke rod and radially movable with respect to the stroke rod between a disengaged position and an engaged position, and an actuator coupled to the catch so as to selectively move the catch between the inward and outward positions, wherein in the disengaged position, the stroke rod is freely movable with respect to the first hammer in the first axial direction and in a second axial direction opposite the first axial direction, and in the engaged position, the catch is positioned for engagement with the first hammer so that the stroke rod becomes fixed to the first hammer during movement in the second axial direction. Embodiments of the method for creating a jarring force may generally include: Engaging a first hammer by a stroke rod;

moving the first hammer by the stroke rod in a second axial direction opposite a first axial direction so as to compress a first spring; and then disengaging the stroke rod from the first hammer so as to allow the first spring to move the first hammer into striking engagement with an anvil, thereby providing the jarring force within the wellbore in the first axial direction.

Any of the foregoing embodiments may include any one of the following elements or characteristics, alone or in combination with each other: A second hammer movably disposed within the housing at a second side of the anvil opposite the first side; a second spring disposed within the housing so as to urge the second hammer toward the anvil in the second axial direction; the stroke rod is selectively movable with respect to the second hammer; in the disengaged position, the stroke rod is freely movable with respect to the second hammer in the first and second axial directions; in the engaged position, the catch is positioned for engagement with the second hammer so that the stroke rod becomes fixed to the second hammer during movement in the first axial direction; a stroker tool connected to the stroke rod and operable to selectively move the stroke rod in the first and second axial directions with respect to the housing; the actuator is coupled to the stroker tool so that the stroker tool controls the actuator; the first hammer has a longitudinal bore formed therethrough; the stroke rod is axially movable through the longitudinal bore; the first hammer is cylindrical; the anvil is cylindrical; a tapered aperture radially formed in a wall of the stroke rod; a finger movably captured within the tapered aperture by a cone, the cone being axially movable within the stroke rod by the actuator; when the catch is in the disengaged position, a smaller portion of the cone engages the finger thereby allowing the ball to be substantially contained within the stroke rod; when the catch is in the engaged position, a larger portion of the cone engages the finger thereby forcing the ball to be partially located outside of the stroke rod; the finger is a ball; the housing is arranged for connection along a string; a second hammer movably disposed within the housing and positioned on a second side of the anvil opposite the first side; a second spring disposed within the housing to urge the second hammer toward the anvil in the second axial direction; the stroke rod is selectively movable with respect to the second hammer; in the disengaged position, the stroke rod is freely movable with respect to the second hammer in the first and second axial directions; in the engaged position, the catch is positioned for engagement with the second hammer so that the stroke rod becomes fixed to the second hammer during movement in the first axial direction; a stroker tool disposed along the drill string and connected to the stroke rod so as to selectively move the stroke rod in the first and second axial directions with respect to the housing; the actuator is coupled to the stroker tool so that the stroker tool controls the actuator; the first hammer has a longitudinal bore formed therethrough; the stroke rod is axially movable through the longitudinal bore; the first hammer is cylindrical; the anvil is cylindrical; a tapered aperture radially formed in a wall of the stroke rod; a ball movably captured within the tapered aperture by a cone having a first portion with a first diameter and a second portion with a second diameter, the cone being axially movable within the stroke rod by the actuator; when the catch is in the disengaged position, the second portion of the cone engages the ball thereby allowing the ball to be substantially contained within the stroke rod; when the catch is in the engaged position, the first portion of the cone engages the ball and urges the ball to extend radially outward from the stroke rod; the conveyance is a string; the conveyance is a wireline cable; engaging a second hammer by the stroke rod; moving the second hammer by the stroke rod in the first axial direction so as to compress a second spring; disengaging the stroke rod from the second hammer so as to allow the second spring to move the second hammer into striking engagement with the anvil, thereby providing the jarring force within the wellbore in the second axial direction; actuating a stroker tool to move the stroke rod; moving a catch carried by the stroke rod to a disengaged engaged position so that in the disengaged position, the stroke rod is freely movable in the first and second axial directions with respect to the first hammer; moving the catch to an engaged position so that the stroke rod becomes fixed to the first hammer during movement in the second axial direction; moving a cone axially within the stroke rod so that a first portion of the cone engages a finger to force the finger to at least partially extend outward from the stroke rod; moving the cone axially within the stroke rod so that a second portion of the cone engages the finger thereby allowing the finger to be urged radially inward into the stroke rod by the first hammer; moving the cone by an actuator located within the stroke rod; and passing a portion of the stroke rod through the first hammer.

The Abstract of the disclosure is solely for providing the reader a way to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A jarring tool assembly, comprising:

a housing;

an anvil fixed within an interior of said housing, the anvil defining obverse striking surfaces on first and second sides thereof;

a first hammer movably disposed within said housing at said first side of said anvil and biased towards said anvil in a first axial direction;

a second hammer movably disposed within said housing at said second side of said anvil and biased towards said anvil in a second axial direction;

a stroke rod at least partially disposed and axially movable within said housing, said stroke rod being selectively axially movable with respect to said first and second hammers in the first and second axial directions, said stroke rod selectively engageable with the first hammer to move the first hammer in said second axial direction and selectively engageable with the second hammer to move the second hammer in said first axial direction, wherein said stroke rod is selectably releasable from said first and second hammers to permit the first and second hammers to be accelerated toward said striking surfaces on said respective first and second sides of the anvil.

2. The jarring tool assembly of claim 1 further comprising:

a first spring and a second spring disposed within said housing so as to urge said first hammer and said second hammer toward said anvil.

3. The jarring tool assembly of claim 1 further comprising:

a stroker tool connected to said stroke rod and operable to selectively move said stroke rod in said first and second axial directions with respect to said housing.

4. The jarring tool assembly of claim 3 further comprising:

a catch carried by said stroke rod and being radially movable with respect to said stroke rod between a disengaged position and an engaged position for respectively releasing and engaging said first hammer and said second hammer; and an actuator coupled to said catch so as to selectively move said catch between said disengaged and engaged positions; wherein said actuator is coupled to said stroker tool so that said stroker tool controls said actuator.

5. The jarring tool assembly of claim 4 wherein said catch comprises:

a tapered aperture radially formed in a wall of said stroke rod;

a finger including a ball, wherein said finger is movably captured within said tapered aperture by a cone, said cone being axially movable within said stroke rod by said actuator; wherein when said catch is in said disengaged position, a smaller portion of said cone engages said finger thereby allowing said ball to be substantially contained within said stroke rod; and when said catch is in said engaged position, a larger portion of said cone engages said finger thereby forcing said ball to be partially located outside of said stroke rod.

6. The jarring tool assembly of claim 1 wherein:

said first hammer is cylindrical; and said anvil is cylindrical.

7. The jarring tool assembly of claim 1 wherein:

said housing is arranged for connection along a string.

8. A method for creating a jarring force in a wellbore, comprising:

engaging a first hammer with a stroke rod;

passing a portion of said stroke rod through said first hammer;

moving said first hammer with said stroke rod in a second axial direction opposite a first axial direction; then disengaging said stroke rod from said first hammer so as to allow said first hammer to be urged to move into striking engagement with a first side of an anvil, thereby providing said jarring force within the wellbore in said first axial direction;

engaging a second hammer by said stroke rod;

moving said second hammer by said stroke rod in said first axial direction; and then disengaging said stroke rod from said second hammer so as to allow said second hammer to be urged to move into striking engagement with a second side of said anvil, thereby providing said jarring force within the wellbore in said second axial direction.

9. The method of claim 8 further comprising:

actuating a stroker tool to move said stroke rod.

10. The method of claim 8 further comprising:

moving a catch carried by said stroke rod to a disengaged position so that in said disengaged position, said stroke rod is freely movable in said first and second axial directions with respect to said first hammer; and moving said catch to an engaged position so that said stroke rod becomes fixed to said first hammer during movement in said second axial direction.

11. The method of claim 8 further comprising:

moving a cone axially within said stroke rod so that a first portion of said cone engages a finger to force said finger to at least partially extend outward from said stroke rod; and moving said cone axially within said stroke rod so that a second portion of said cone engages said finger thereby allowing said finger to be urged radially inward into said stroke rod by said first hammer.

12. The method of claim 11 further comprising:

moving said cone by an actuator located within said stroke rod.

13. A jarring system for use in a wellbore, comprising:

a conveyance; and a jar carried by said conveyance and disposed within said wellbore, said jar including, an anvil fixed within the interior of a housing, the anvil defining obverse striking surfaces on first and second sides thereof, a first hammer movably disposed within said housing and positioned on said first side of said anvil, said first hammer movable towards said anvil in a first axial direction, a second hammer movably disposed within said housing at said second side of said anvil and movable towards said anvil in a second axial direction opposite the first axial direction;

a stroke rod at least partially and movably disposed within said housing, said stroke rod being selectively axially movable with respect to said first and second hammers through a longitudinal bore in the first and second axial directions, a catch carried by said stroke rod and radially movable with respect to said stroke rod between a disengaged position and an engaged position, and an actuator coupled to said catch so as to selectively move said catch between said disengaged and engaged positions, wherein when said catch is in said disengaged position, said stroke rod is freely movable with respect to said first and second hammers in said first axial direction and in said second axial direction opposite the first axial direction, such that said first hammer is movable into striking engagement with said striking surface on said first side of said anvil and such that said second hammer is movable into said striking engagement with said striking surface on said second side of said anvil; and when said catch is in said engaged position, said catch is positioned for engagement with said first hammer or said second hammer so that said stroke rod becomes fixed to said first hammer during movement in said second axial direction or fixed to said second hammer during movement in said first axial direction.

14. The jarring system of claim 13 wherein said jar further comprises:

a first spring and a second spring disposed within said housing to urge said first and second hammers toward said anvil in said first and second axial directions respectively.

15. The jarring system of claim 13 further comprising:

a stroker tool disposed along said conveyance and connected to said stroke rod so as to selectively move said stroke rod in said first and second axial directions with respect to said housing.

16. The jarring system of claim 15 wherein:

said actuator is coupled to said stroker tool so that said stroker tool controls said actuator.

17. The jarring system of claim 13 wherein:

said first hammer is cylindrical; and said anvil is cylindrical.

18. The jarring system of claim 13 wherein said catch comprises:

a tapered aperture radially formed in a wall of said stroke rod;

a ball movably captured within said tapered aperture by a cone having a first portion with a first diameter and a second portion with a second diameter, said cone being axially movable within said stroke rod by said actuator; wherein when said catch is in said disengaged position, the second portion of said cone engages said ball thereby allowing said ball to be substantially contained within said stroke rod; and when said catch is in said engaged position, the first portion of said cone engages said ball and urges said ball to extend radially outward from said stroke rod.

19. The jarring system of claim 13 wherein:

said conveyance is a string.

20. The jarring system of claim 13 wherein:

said conveyance is a wireline cable.

21. A jarring tool assembly, comprising:

a housing;

an anvil fixed within an interior of said housing;

a first hammer movably disposed within said housing at a first side of said anvil;

a first spring disposed within said housing so as to urge said first hammer towards said anvil in a first axial direction;

a stroke rod at least partially disposed and axially movable within said housing, said stroke rod being selectively movable with respect to said first hammer;

a catch carried by said stroke rod and being radially movable with respect to said stroke rod between a disengaged position and an engaged position;

an actuator coupled to said catch so as to selectively move said catch between said disengaged and engaged positions; wherein in said disengaged position, said stroke rod is freely movable with respect to said first hammer in said first axial direction and in a second axial direction opposite the first axial direction; and in said engaged position, said catch is positioned for engagement with said first hammer so that said stroke rod becomes fixed to said first hammer during movement in said second axial direction;

a second hammer movably disposed within said housing at a second side of said anvil opposite said first side; and a second spring disposed within said housing so as to urge said second hammer toward said anvil in said second axial direction; wherein said stroke rod is selectively movable with respect to said second hammer;

in said disengaged position, said stroke rod is freely movable with respect to said second hammer in said first and second axial directions; and in said engaged position, said catch is positioned for engagement with said second hammer so that said stroke rod becomes fixed to said second hammer during movement in said first axial direction.

22. A jarring system for use in a wellbore, comprising:

a conveyance; and a jar carried by said conveyance and disposed within said wellbore, said jar including the jarring tool assembly of claim 21.

23. A method for creating a jarring force in a wellbore, comprising:

engaging a first hammer with a stroke rod;

moving said first hammer with said stroke rod in a second axial direction opposite a first axial direction so as to compress a first spring; then disengaging said stroke rod from said first hammer so as to allow said first spring to move said first hammer into striking engagement with an anvil, thereby providing said jarring force within the wellbore in said first axial direction;

engaging a second hammer by said stroke rod;

moving said second hammer by said stroke rod in said first axial direction so as to compress a second spring; and then disengaging said stroke rod from said second hammer so as to allow said second spring to move said second hammer into striking engagement with said anvil, thereby providing said jarring force within the wellbore in said second axial direction.

* * * * *